United States Patent [19]

Bech

[11] Patent Number: 4,773,296

[45] Date of Patent: Sep. 27, 1988

[54] MAGNETIC MUTE SYSTEM FOR VIOLIN FAMILY MUSIC INSTRUMENTS

[76] Inventor: Terence R. Bech, Chrysantenstraat 48, 1214 BN Hilversum, Netherlands

[21] Appl. No.: 114,725

[22] Filed: Oct. 30, 1987

[30] Foreign Application Priority Data

Dec. 2, 1986 [NL] Netherlands ..... 8603070

[51] Int. Cl.[4] ..... G10D 3/04

[52] U.S. Cl. ..... 84/310

[58] Field of Search ..... 84/310, 311

[56] References Cited

U.S. PATENT DOCUMENTS 3,181,410 5/1965 Phillips ..... 84/322

3,552,255 1/1971 Kaston ..... 84/310

*Primary Examiner*—Lawrence R. Franklin

[57] ABSTRACT

A magnetic mute system for violin family music instruments having at least one magnet and one magnetic attachment point whereby the mute is prevented from making noise when restrained in rest position by the magnet and in addition comprising two anti-rotation legs and a flaired foot for guiding the mute unaided by the eye between its working position and rest position.

1 Claim, 1 Drawing Sheet

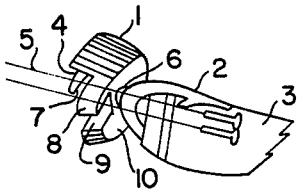
FIG. 6
FIG. 2A
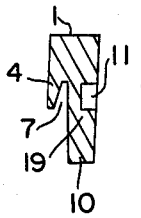
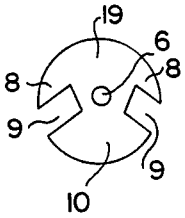
FIG. 2B
FIG. 2C
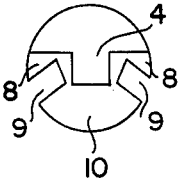
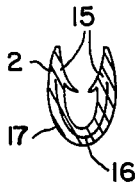
FIG. 3A
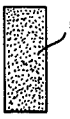
FIG. 3B
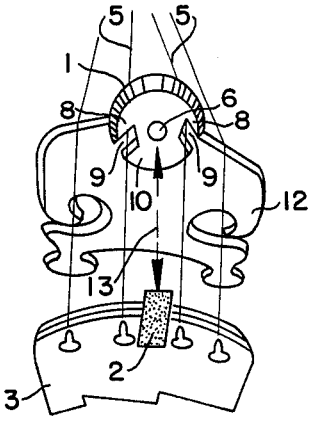
FIG. 4
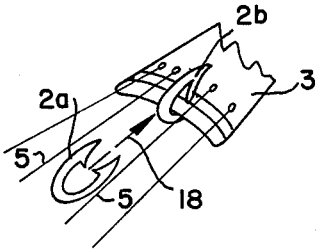
FIG. 5
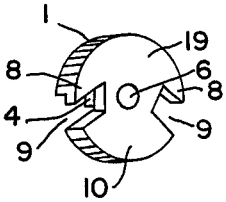
FIG. 1

MAGNETIC MUTE SYSTEM FOR VIOLIN FAMILY MUSIC INSTRUMENTS

FIELD OF THE INVENTION

The invention relates to mutes for the violin family of music instruments and in particular to a novel mute system incorporating a magnet, a steel clip, a broad flaired foot, and anti-rotation legs.

BACKGROUND OF THE INVENTION

Violin family music instrument mutes are used to change the timbre and loudness of these instruments. These mutes consist of a wooden, rubber, leather, plastic, metal, or multi-material device that regardless of differences in the materials used or their form, function as a clamp on the top of the instrument's bridge, thereby muting the instrument. A mute is a required accessory for the performance of many solo and orchestral pieces of music.

The mute poses several problems for the performer when the mute is not in use or when it is being transferred from its rest position to its working position on the bridge. The problems center on having the mute convenient for immediate use. Six solutions to these problems are currently in use:

1. As its rest position, the mute is put somewhere close at hand, i.e., on the music stand, in a pocket, on a chair;
2. At its rest position, the mute is clamped onto one or two strings between the bridge and the tail piece and must be removed from the string(s) to be used;
3. At its rest position, the mute is found as an extension of a pivoting device clamped permanently between the two middle strings between the bridge and the tail piece;
4. At its rest position, the mute is permanently clamped onto the two middle strings between the bridge and the tail piece, but is flexible enough to be slid onto and off of the bridge from its rest position;
5. At its rest position, the mute sits loose between the bridge and the tail piece on one or two of the two middle strings that pass through and are completely enclosed in holes passing through the mute's body;
6. At its rest position, the mute is attached and permanently connected to the tail piece by an elastic device.

Each of these six solutions has its drawbacks:

1. Sitting loose away from the instrument, the mute can fall onto the floor or require more time than allowed for in the music in looking and reaching for it and in returning it to its rest position;
2. These types of mutes require precise visual manipulation when being transferred back and forth between the rest position and the working position, taking much time and concentration away from the music;
3. The pivot clamped permanently between the strings causes a continual slight muting of the instrument and the large pivot arc makes it awkward to transfer the mute from its rest position to the working position and back to rest, where the mute sometimes rattles against the tail piece when the instrument is being played;
4. Sliding the steel wire clamps of this type of mute abraid the strings and string wrappings and give a disturbing click sound when clamped onto the strings, it causes a slight muting even when in rest position;
5. The instrument's vibrations cause this type of mute to frequently rattle noisely in rest position during performances and even migrate unwanted upto and against the bridge;
6. The elastic and mute can cause a disturbing noise if the mute slips from the performer's fingers and requires precise visual attention when being transferred between rest and working positions.

DESCRIPTION OF THE INVENTION

The magnetic mute system for violin family music instruments as claimed is intended to remedy the drawbacks and inherent disadvantages of the six types of mutes listed above, while at the same time incorporating their advantages. The invention solves the problems of how to hold a mute in rest position on a violin family music instrument ready for use, without clamping it onto or between a string or strings or permanently fixing it to an elastic extension from the tail piece or allowing the mute to sit loose on the strings.

The advantages offered by the invention are mainly that the means of fastening the mute to a violin family instrument do not result in or subject the instrument to any abrasion, muting or extranious secondary noise effects. The invention also makes the mute convenient and immediately accessable due to its being passively held by a magnet in rest position.

The invention's use of a broad flaired foot on the middle leg of the mute allows the two middle strings to function as a blind guide for the mute's movement between the bridge and the tail piece during a performance, without the musician having to remove his eyes from the music.

DESCRIPTION OF THE DRAWINGS

A magnetic mute system for violin family music instruments.

One way of carrying out the invention is described in detail below with reference to drawings that illustrate only one specific embodiment, in which:

FIG. 1 shows a mute in accordance with the invention.

FIG. 2A shows a cross section of the mute in FIG. 1.

FIG. 2B shows the magnetic side of the mute in FIG. 1.

FIG. 2C shows the clamping side of the mute in FIG. 1.

FIG. 3A shows a cross section of the coated steel clip in accordance with the invention.

FIG. 3B shows a top view of the clip in FIG. 3A.

FIG. 4 shows the mute in FIG. 1 in working position.

FIG. 5 shows how the clip is attached in accordance with the invention.

FIG. 6 shows the mute in FIG. 1 in rest position in accordance with the invention.

The violin family music instrument mute 1 in accordance with the invention has four legs 4, 8, 19, three legs 8, 19 on one side and one leg 4 on the other side of a wedge shaped channel 7 through the body of the mute 1. These legs 4, 8, 19 on opposing sides of the channel 7 form a clamp when inserted over the top of the bridge 12, thus muting the instrument's sound production.

In accordance with the invention, the two outer legs 8 in addition to their clamping function also prevent the mute 1 from accidently rotating off the strings 5 when the mute 1 is moved between the bridge 12 and the tail piece 3 as in FIG. 4.

In accordance with the invention, the middle leg 19 is longer than the other three legs 4, 8 and has a magnet 6 built into it that restrains the mute 1 against the steel clip 2 at the tail piece 3 when the mute 1 is in rest position FIG. 6. Also in accordance with the invention, the middle leg 19 has a flaired foot 10 extending below the magnet 6. The flaired foot 10 functions as a guide for the mute 1 and prevents it from being pulled through or loose from the two strings 5 when being transferred between the bridge 12 and the steel clip 2 on the tail piece 3.

FIG. 1 is a perspective view of a mute 1 in accordance with the invention showing three novel features: (1) a magnet 6 that restrains the mute 1 in rest position as in FIG. 6; (2) two side legs 8 that keep the mute 1 from rotating off the strings 5 when moving 13 between the bridge 12 and the tail piece 3 as in FIG. 4; (3) a flaired foot 10 on the middle leg 19 extending below the magnet 6, the foot 10 functioning to assist guiding the mute 1, preventing the mute 1 from being unintentionally pulled loose from the strings 5 when being moved between rest position as in FIG. 6 and working position as in FIG. 4.

FIG. 2A shows a cross section of the mute in FIG. 1 including the longer middle leg 19 and the clamping channel 7 that is inserted over the bridge 12 to produce the muting effect. The insert hole 11 for the magnet 6 is also shown in the middle leg 19.

FIG. 2B shows the magnetic side of the mute in FIG. 1 including: the anti-rotation legs 8, the flaired guide foot 10, the essentially open string passages 9 between the outer legs 8 and middle leg 19, and the placement of the magnet 6 so that it holds the mute 1 away from the strings 5 when in rest position on the steel clip 2.

FIG. 2C shows the clamping side of the mute in FIG. 1, including the leg 4 that opposes the other three legs 8, 19 to form the mute's 1 clamping furfaces 7.

In accordance with the invention, FIG. 3A shows a cross section of the steel clip 2 that has a flexible PVC coating to protect the tail piece wood 3 from the steel core 16 when being inserted 18 over the tail piece 3. The flexible toothed jaws 15 prevent the clip 2 from accidently coming loose from the tail piece 3. The clip 2 has a flat core 16 giving a secure face for the magnet's 6 attachment.

FIG. 3B shows the width 14 of the clip in FIG. 3A as seen from above. The clip's PVC coating 17 has a textured surface 14 for improved grip when attaching the clip 2 to the tail piece 3.

FIG. 4 shows the mute 1 in FIG. 1 and the clip in FIG. 3 in perspective in working position, the clip 2 attached to the tail piece 3 and the mute 1 on the bridge 12. Also shown is the movement 13 of the mute 1 between the bridge 12 and the clip 2 as well as how the flaired foot 10 extends under the strings 5 as guide for the mute's 1 movement 13. The anti-rotation legs 8 are also shown in relation to the strings 5 to either side of which they extend preventing accidental disengagement of the mute when being moved 13.

FIG. 5, in accordance with the invention, shows how the steel clip **2*a* is attached 2*b* by pushing it 18 over the end of the tail piece 3** between the two middle strings.

FIG. 6, in accordance with the invention, shows the mute in FIG. 1 in rest position, held against the clip 2 on the tail piece 3 by its in-built magnet 6 where the magnet 6 restrains the mute 1 from vibrating against the strings 5, preventing unwanted noise developing from interaction of the mute 1 and strings 5.

I claim:

1. A magnetic system for violin family music instrument mutes comprising a clamping portion; an inbuilt magnet; anti-rotation legs extending down on either side of the two middle strings; a flaired blind guide foot extending under the strings preventing the mute from coming loose as well as making unnecessary any visual contact with the mute when moving it between rest position and working position; two essentially open and downward extending passages for the strings between the anti-rotation legs and the central leg providing unrestricted movement of the mute between rest position and working position; a steel clip attached to the tail piece that provides the restraining point for the mute's magnet when the mute is placed in rest position.

* * * * *